US010947799B2

(12) United States Patent
Perez et al.

(10) Patent No.: US 10,947,799 B2
(45) Date of Patent: Mar. 16, 2021

(54) ANTI-PRESET MECHANISM FOR SETTING PISTON IN DOWNHOLE TOOLS

(71) Applicant: Halliburton Energy Services, Inc., Houston, TX (US)

(72) Inventors: Eddie Eddieberto Perez, McKinney, TX (US); Christopher Robert Delzell, Plano, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 220 days.

(21) Appl. No.: 16/074,615

(22) PCT Filed: May 24, 2016

(86) PCT No.: PCT/US2016/033880
§ 371 (c)(1),
(2) Date: Aug. 1, 2018

(87) PCT Pub. No.: WO2017/204785
PCT Pub. Date: Nov. 30, 2017

(65) Prior Publication Data

US 2019/0040699 A1 Feb. 7, 2019

(51) Int. Cl.

| | |
|---|---|
| ***E21B 23/06*** | (2006.01) |
| ***E21B 23/01*** | (2006.01) |
| ***E21B 33/128*** | (2006.01) |
| ***E21B 34/14*** | (2006.01) |

(52) U.S. Cl.
CPC ..... *E21B 23/06* (2013.01); *E21B 23/01* (2013.01); *E21B 33/1285* (2013.01); *E21B 34/14* (2013.01)

(58) Field of Classification Search
CPC ..... E21B 23/00–14; E21B 33/1295; E21B 33/129; E21B 33/126; E21B 33/1265; E21B 33/1285; E21B 43/10–108; E21B 34/14; E21B 34/142; E21B 41/00; E21B 41/0092; E21B 41/0099; E21B 17/06
See application file for complete search history.

(56) References Cited

U.S. PATENT DOCUMENTS

| | | | |
|---|---|---|---|
| 5,180,016 | A | 1/1993 | Ross et al. |
| 5,332,045 | A | 7/1994 | Ross et al. |
| 5,375,662 | A | 12/1994 | Echols, III et al. |

(Continued)

FOREIGN PATENT DOCUMENTS

| | | | |
|---|---|---|---|
| WO | 2008076189 | A2 | 6/2008 |

OTHER PUBLICATIONS

Patent Cooperation Treaty, International Search Report and Written Opinion, PCT Appln. No. PCT/US2016/033880, dated Feb. 23, 2017.

(Continued)

*Primary Examiner* — George S Gray
(74) *Attorney, Agent, or Firm* — McGuireWoods LLP

(57) ABSTRACT

Downhole setting systems and methods for setting downhole tools in subterranean formations. An example downhole setting system comprises a downhole setting assembly and a downhole tool configured to be set by the downhole setting assembly. The downhole setting assembly comprises a setting piston, and a mating element that physically constrains the setting piston from translating; the mating element configured to release and permit the setting piston to translate.

20 Claims, 8 Drawing Sheets

(56) References Cited

U.S. PATENT DOCUMENTS

| | | | | |
|---|---|---|---|---|
| 7,591,321 | B2 | 9/2009 | Whitsitt et al. | |
| 2003/0019623 | A1* | 1/2003 | King | E21B 33/1295 166/120 |
| 2010/0012330 | A1* | 1/2010 | Ezell | E21B 33/1285 166/387 |
| 2011/0209867 | A1* | 9/2011 | Nevels | E21B 41/00 166/181 |
| 2015/0308206 | A1* | 10/2015 | Yue | E21B 23/06 166/387 |

OTHER PUBLICATIONS

Halliburton, ZonePac System Improving Recovery in Openhope Grave-Packed Wells, H012078, Feb. 2016, sheet 4.
Halliburton, Sand Control Solutions, Downhole Sand Control Components, H04430, Dec. 2013, pp. 3-42.

* cited by examiner

ANTI-PRESET MECHANISM FOR SETTING PISTON IN DOWNHOLE TOOLS

TECHNICAL FIELD

The present disclosure relates to downhole tools for use in a wellbore environment and more particularly to anti-preset mechanisms for the setting or actuating pistons of downhole tools that use applied pressure.

BACKGROUND

In a wellbore it may be desirable to set or actuate a downhole tool using applied pressure. For example, applied pressure may be used to unlock a travel/compaction joint, to set a mechanical liner hanger, to set an expandable liner hanger, to lock or unlock pressure actuated downhole valves, or to set a packer.

In particular, in a well completion, a packer may be installed to isolate and contain produced fluids and pressures in the wellbore. The packer is a sealing element that may be used to protect the casing and/or formation above or below the producing zone. There are many different types of packers and many ways to set a packer into a desired location.

One method of setting a packer is a hydraulic setting tool. A hydraulic setting tool uses a predetermined amount of hydraulic pressure applied to the tubing string to achieve a pressure differential at the packer which is used to set the packer. Some types of hydraulic setting tools can utilize the hydrostatic pressure in the well to provide the pressure differential.

A hydraulic setting tool generally comprises a setting chamber which is adjacent to the setting piston. The setting chamber is enclosed except for a port which allows for the setting chamber to be in fluid communication with the rest of the wellbore. If the hydrostatic pressure in the wellbore increases, so too will the pressure in the setting chamber, and if the pressure differential acting across the setting piston reaches the predetermined amount, the setting piston will translate and set the packer.

As hydraulic setting tools rely on a pressure differential to set a packer, the packer may be prematurely set if the pressure in the setting chamber is increased prematurely. For example, tubing washdown circulation from the surface prior to setting the packer may generate sufficient pressure to induce premature packer setting. Anti-preset mechanisms may be used to eliminate premature setting of the packer. One such anti-preset mechanism is the use of an isolation sleeve. The isolation sleeve covers the setting port and prevents fluid communication between the tubing and the setting chamber. However, isolation sleeves may create what is known as an atmospheric trap in the setting chamber. Since the isolation sleeve prevents fluid communication between the setting chamber and the tubing string, the pressure within the setting chamber may be at or close to atmospheric pressure. As the hydrostatic pressure in the wellbore increases, the metallic components around the setting chamber may undergo plastic deformation as the pressure in the setting chamber is not equalized with the hydrostatic pressure. The hydraulic setting tool may become damaged and may not function as desired. Consequently, operation downtime and expenditures may be increased. Alternatively, if an isolation sleeve is not used, the hydraulic setting tool may prematurely set the packer which may also increase operation downtime and expenditures.

BRIEF DESCRIPTION OF THE DRAWINGS

Illustrative examples of the present disclosure are described in detail below with reference to the attached drawing figures, which are incorporated by reference herein, and wherein.

The illustrated figures are only exemplary and are not intended to assert or imply any limitation with regard to the environment, architecture, design, or process in which different examples may be implemented.

DETAILED DESCRIPTION

The present disclosure relates to downhole tools for use in a wellbore environment and more particularly to anti-preset mechanisms for the setting or actuating pistons of downhole tools that use applied pressure.

Disclosed examples may include a downhole setting assembly for use in packer setting tools, for example, a hydraulic setting tool. Although the downhole setting assembly is illustrated as setting a packer, it is to be understood that the examples disclosed may be used for any downhole tool that uses applied pressure for actuation. For example, the disclosed examples may be used to unlock a travel/compaction joint, to set a mechanical liner hanger, to set an expandable liner hanger, or to lock or unlock pressure actuated downhole valves. This disclosure expressly contemplates uses other than setting packers, and the examples illustrated herein may be used in any downhole tool where actuation is dependent upon applied pressure.

The downhole setting assembly may comprise a setting piston and a setting chamber. A mating element prevents the setting piston from translating as pressure builds in the setting chamber. When it is desired to set a packer, a ball may be dropped to shear and initiate axial translation of a lock-out sleeve. The axial translation of the lock-out sleeve unsupports the mating element which releases the setting piston. The pressure differential from tubing to annulus which acts across the setting piston from within the setting chamber induces the setting piston to translate, and this movement may cause the packer to be set. Embodiments of the present disclosure and its advantages may be understood by referring to FIGS. 1A through 3D, where like numbers are used to indicate like and corresponding parts.

Figure 1A:
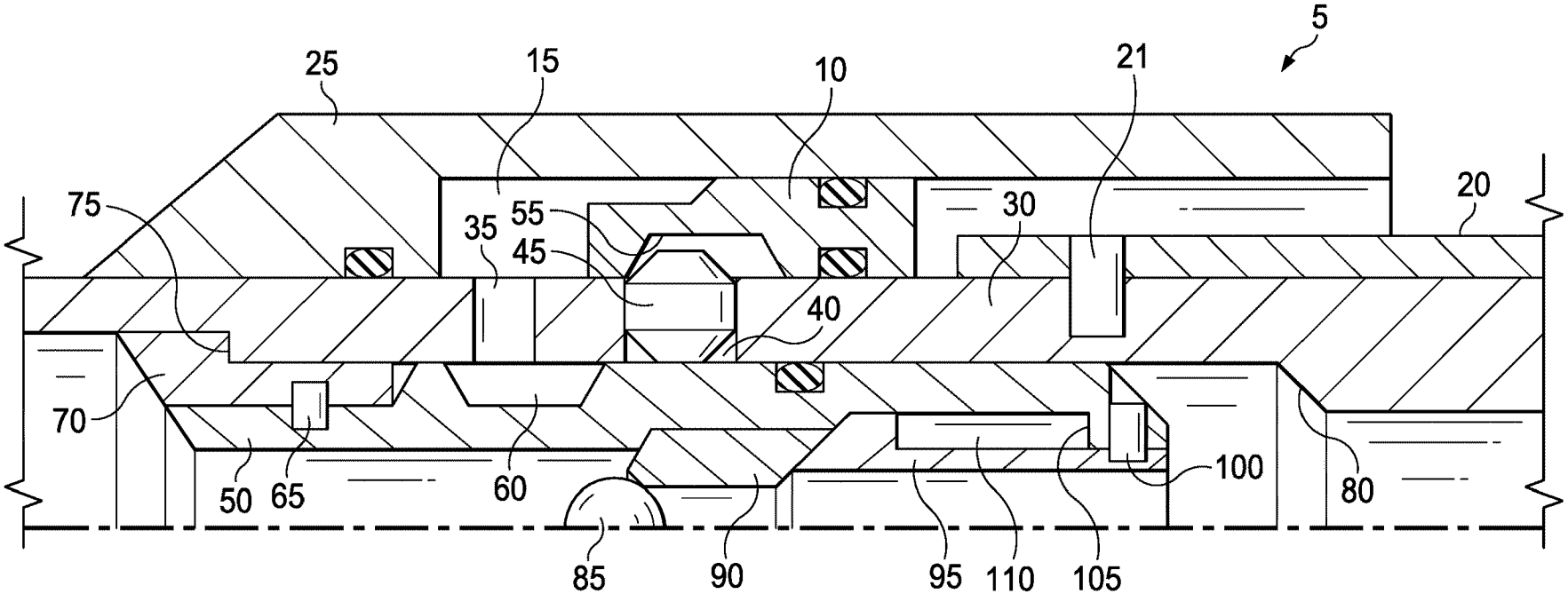
FIG. 1A is a cross-sectional view of a downhole setting assembly in the run position with the ball engaged in the ball seat.
Figure 1B:
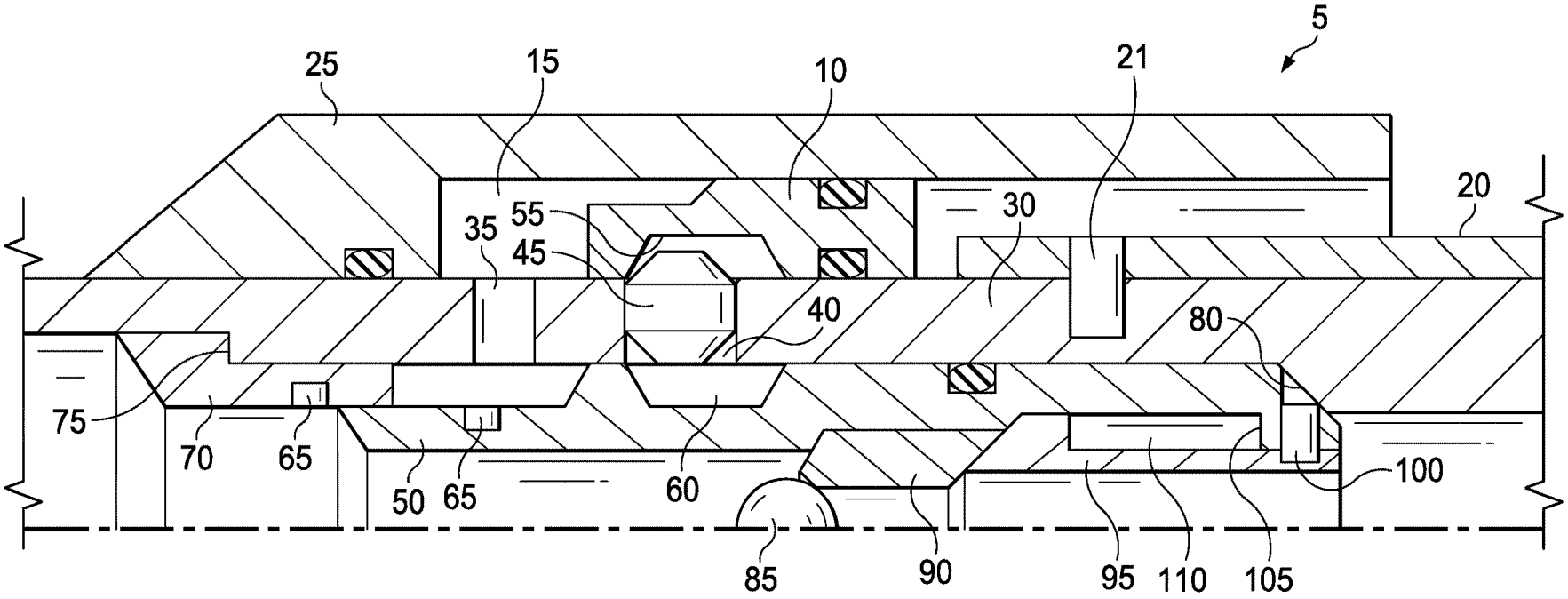
FIG. 1B is a cross-sectional view of a downhole setting assembly with the lock-out sleeve sheared.
Figure 1C:
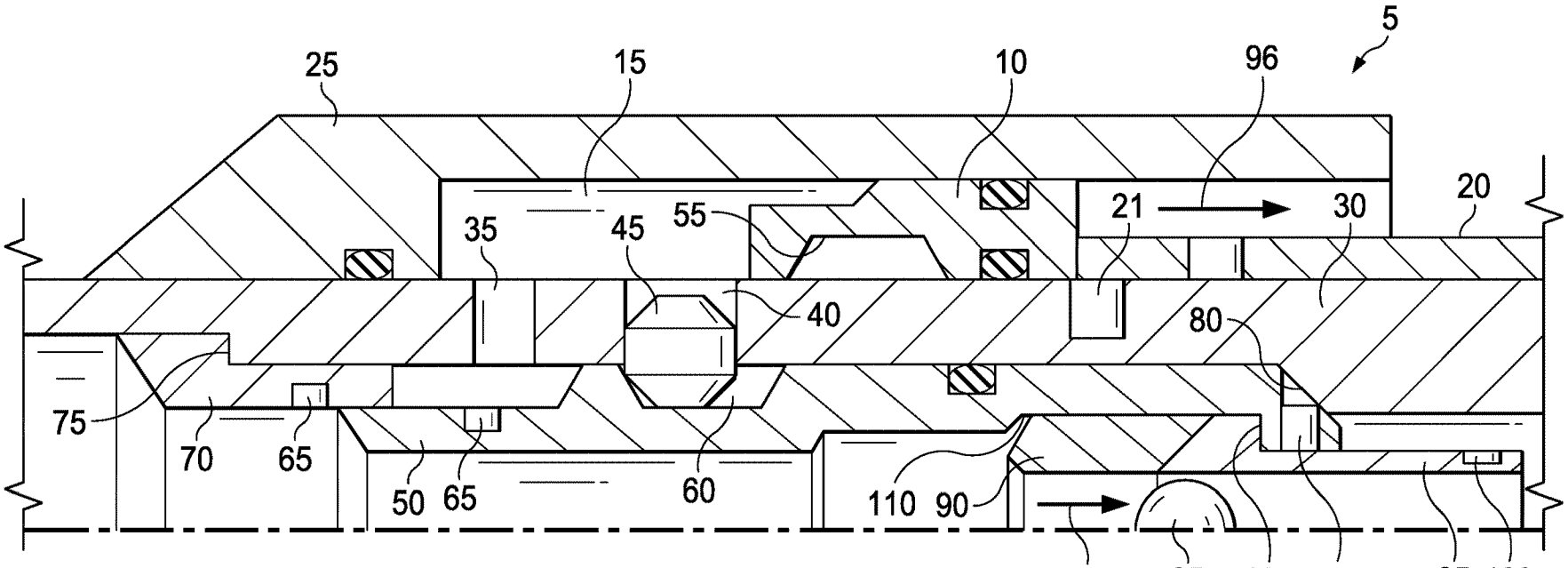
FIG. 1C is a cross-sectional view of a downhole setting assembly with the setting piston fully released.

FIGS. 1A-1C illustrate a cross-sectional view of a downhole setting assembly 5, which is illustrated as being used in packer setting methods and systems. Downhole setting assembly 5 may be used in any setting tool that utilizes a pressure differential to actuate the setting mechanism. For example, downhole setting assembly 5 may be used in a hydraulic packer setting tool. Downhole setting assembly 5 comprises setting piston 10 and setting chamber 15. Setting piston 10 may be any type of piston suitable for moving piston extension 20. As will be shown below in FIGS. 3A-3D, piston extension 20 is the component which contacts and sets the packer (e.g., packer 305, as illustrated in FIGS. 3A-3D). Setting chamber 15 is defined by at least the piston housing 25, the mandrel 30, an opening of port 35, and the setting piston 10. Setting piston 10 is configured such that it is capable of movement within setting chamber 15.

Port 35 is an opening through mandrel 30. Port 35 allows the pressure within setting chamber 15 to be equalized with the pressure in the wellbore. Port 35 remains open throughout the use of the downhole setting assembly 5, which includes when the packer setting tool is introduced and run in the wellbore. As such, downhole setting assembly 5 does not comprise an isolation sleeve or other such mechanism for closing or blocking port 35 in any manner such that setting chamber 15 is not in fluid communication with the wellbore. The pressure in setting chamber 15 will therefore be equalized with the pressure in the wellbore during the entirety of the packer setting operation.

Piston housing 25 and mandrel 30 at least partially define setting chamber 15. Piston housing 25 and mandrel 30 may be made of any such material sufficient for setting a packer. Examples of such materials may include stainless steel, carbon steels, nickel alloys, or combinations thereof. Because port 35 is in constant fluid communication with the wellbore, the pressure in setting chamber 15 will be equalized with the wellbore. As such, setting chamber 15 may not comprise an atmospheric trap as discussed above. As used herein, "atmospheric trap" refers to a setting chamber 15 which has been enclosed such that the pressure within setting chamber 15 is less than that of the pressure within the wellbore. Because setting chamber 15 may not comprise an atmospheric trap, there is no risk of deformation of the piston housing 25 and mandrel 30. Thus, piston housing 25 and mandrel 30 may be made from a wider variety of materials than may be used in packer setting assemblies where the deformation of components due to atmospheric trap is a risk. Further, a downhole setting assembly with an atmospheric trap may be limited to a certain running depth based on factors including wellbore fluid weight, reservoir temperature, and pressure applied from the surface. Eventually, the downhole setting assembly will reach a depth where the hydrostatic pressure exceeds the limits of the downhole setting assembly. A downhole setting assembly without an atmospheric trap is not limited to a certain running depth as described above. This may be especially important in offshore deepwater applications where high temperatures and high hydrostatic pressure are anticipated.

Piston housing 25 and mandrel 30 may be any such shape and size to at least partially define a setting chamber 15 sufficient for allowing a pressure differential to act across setting piston 10. Additionally, piston housing 25 and mandrel 30 are of sufficient size to accommodate setting piston 10.

In examples, mandrel 30 comprises a slot 40 where a mating element 45 is disposed. The slot 40 is cut through the entirety of the height of mandrel 30. The slot 40 may be any such size and shape to accommodate mating element 45. Mating element 45 is disposed in slot 40 and is greater in height than slot 40 such that mating element 45 rests on lock-out sleeve 50 when the downhole setting assembly 5 is in the run position. A portion of mating element 45 extends outwardly from slot 40 into profile 55 of setting piston 10. Profile 55 is disposed in the outer diameter of setting piston 10. Profile 55 may be a groove, hump, concentric profile, helical profile, a plurality of grooves, a plurality of humps, or a combination thereof. The portion of mating element 45 mated with profile 55 physically constrains setting piston 10 from translating as illustrated in FIGS. 1A and 1B. Therefore, even as the pressure within setting chamber 15 increases, setting piston 10 cannot translate until mating element 45 no longer constrains setting piston 10. Mating element 45 may be any such element sufficient for mating with profile 55 of setting piston 10. For example, mating element 45 may be a lug, a ball, a key, or any combination thereof. Mating element 45 may be any such size and shape necessary to constrain setting piston 10. Mating element 45 may be made of any such material sufficient for constraining setting piston 10. Profile 55 may be any such size and shape necessary to accommodate the portion of mating element 45 used to constrain setting piston 10. In some examples, a plurality of mating elements 45 may be used.

As discussed above, mating element 45 may rest on lock-out sleeve 50 in the run position of the downhole setting assembly 5 as illustrated in FIG. 1A. Lock-out sleeve 50 is adjacent to mandrel 30. Lock-out sleeve 50 comprises a groove 60 in the profile of its outer diameter. As will be explained below and as illustrated in FIGS. 1B and 1C, lock-out sleeve 50 may be induced to move such that groove 60 is adjacent to mating element 45. Groove 60 is of sufficient size and shape necessary to accommodate a portion of mating element 45. Lock-out sleeve 50 further comprises a shearable element 65. Shearable element 65 couples lock-out sleeve 50 to shear ring 70. Shearable element 65 may be a shear pin, shear screw, or any such shearable element in which the shear strength of the shearable element 65 is known. FIG. 1A illustrates shearable element 65 as not sheared. FIGS. 1B and 1C illustrate shearable element 65 as sheared. A portion of shearable element 65 is disposed within lock-out sleeve 50, and another portion of shearable element 65 is disposed within shear ring 70. Shear ring 70 is locked into position via shoulder 75 of mandrel 30, and shear ring 70 does not move from this position. Because shear ring 70 does not move, when the shear load on shearable element 65 exceeds the shear strength of shearable element 65, shearable element 65 may be sheared as illustrated in FIGS. 1B and 1C, and lock-out sleeve 50 may be moved from the position illustrated in FIG. 1A to the position illustrated in FIGS. 1B and 1C where lock-out sleeve 50 is physically constrained by shoulder 80 of mandrel 30. As discussed above, when lock-out sleeve 50 is moved to the position in FIGS. 1B and 1C, groove 60 is positioned such that it is adjacent to mating element 45. As illustrated in FIGS. 1A-1C, profile 55 of the setting piston 10 may be designed such that the pressure differential acting across the setting piston 10 allows the setting piston 10 to push the mating element 45 down further into the slot 45 of the mandrel 30 and into at least a portion of the groove 60 on the lock-out sleeve 50 when the setting piston 10 begins to translate. Alternatively, mating element 45 may be biased against lock-out sleeve 50 through a biasing mechanism or by gravity such that mating element 45 is moved into groove 60 when groove 60 is adjacent to mating element 45.

In examples, the mechanism of moving lock-out sleeve 50 comprises introducing ball 85 into the wellbore such that ball 85 engages ball seat 90. Ball 85 may be any such ball used to engage ball seat 90. It is to be understood that reference to a "ball" is not meant to limit the geometric shape of the ball 85 to spherical, but rather is meant to include any device that is capable of engaging with ball seat 90. A "ball" may be spherical in shape, but may also be a dart, a bar, or any other shape. The ball seat 90 may be any ball seat capable of engaging the ball 85. In some examples, ball seat 90 is a c-ring. Isolation of the area uphole of the ball seat 90 is accomplished by introducing the ball 85 such that it engages with the ball seat 90 of the downhole setting assembly 5. When the ball 85 engages with the ball seat 90, a fluid and pressure tight seal is created by this engagement that prevents fluid communication downhole of the ball seat 90. The terms uphole and downhole may be used to refer to the location of various zones or components relative to the bottom or end of the well. For example, a first zone or component described as uphole from a second zone or component may be further away from the end of the well than the second zone or component. Similarly, a first zone or component described as being downhole from a second zone or component may be located closer to the end of the well than the second zone or component. When the pressure and fluid tight seal is created, pressure may build in the area uphole of the ball seat 90. This pressure may be increased by the use of pumps on the surface or other such means for increasing the pressure in the area uphole of the ball seat 90. As the pressure uphole of the ball seat 90 increases, the pressure differential acting across the lock-out sleeve 50 is increased, and this pressure differential increases the shear load on shearable element 65 until the shear strength of shearable element 65 is exceeded. Shearable element 65 is then sheared, and the lock-out sleeve 50 is moved to the position illustrated in FIGS. 1B and 1C where it is braced against shoulder 80 of mandrel 30. At this position, groove 60 is adjacent to mating element 45, and mating element 45 may move into groove 60 such that setting piston 10 is no longer constrained by mating element 45. Setting piston 10 is now free to translate, and the pressure differential acting across setting piston 10 may translate setting piston 10 such that setting piston 10 moves piston extension 20 and sets a packer as illustrated by arrow 96 in FIG. 1C which completes the packer setting portion of the operation.

As ball 85 is maintained in engagement with ball seat 90 after lock-out sleeve 50 is moved to the position illustrated in FIGS. 1B and 1C, the fluid and pressure tight seal from said engagement is maintained. As such, pressure may continue to build uphole of ball seat 90. As pressure builds uphole of ball seat 90, a pressure differential acts across the ball 85 and ball seat 90. Shear ring 95 is coupled to ball seat 90 such that the pressure differential acting across ball seat 90 also acts across shear ring 95 as illustrated in FIGS. 1B and 1C. Shear ring 95 further comprises a shearable element 100. Shearable element 100 couples lock-out sleeve 50 to shear ring 95. Shearable element 100 may be a shear pin, shear screw, or any such shearable element in which the shear strength of the shearable element 100 is known. FIGS. 1A and 1B illustrate shearable element 100 as not sheared. FIG. 1C illustrates shearable element 100 as sheared. A portion of shearable element 100 is disposed within lock-out sleeve 50, and another portion of shearable element 100 is disposed within shear ring 95. As the pressure differential acting across ball seat 90 increases, so too does the pressure differential acting across shear ring 95. As a consequence, this increase in the pressure differential also increases the shear load on shearable element 100. When the shear load on shearable element 100 exceeds the shear strength of shearable element 100, shearable element 100 may shear as illustrated in FIG. 1C. The shearing of shearable element 100 allows the ball seat 90 and shear ring 95 to move into the position illustrated in FIG. 1C where they are braced against shoulder 105 of lock-out sleeve 50. Ball seat 90 may be biased radially outwards such that when shearable element 100 is sheared, ball seat 90 moves into the groove 110 of the lock-out sleeve 50. When ball seat 90 is in the position illustrated by FIG. 1C, the diameter of the adjacent pathway for the ball 85 is increased and is greater than the diameter of the ball 85. Ball 85 is now able to pass through the downhole setting assembly 5 as indicated by arrow 115 illustrated in FIG. 1C. As the ball 85 is no longer engaged with ball seat 90, the fluid and pressure tight seal from the engagement is removed, and fluid communication between the zone uphole and the zone downhole of the ball seat 90 is reestablished. Operations requiring fluid circulation, for example, sand control, may then be performed.

Figure 2A:
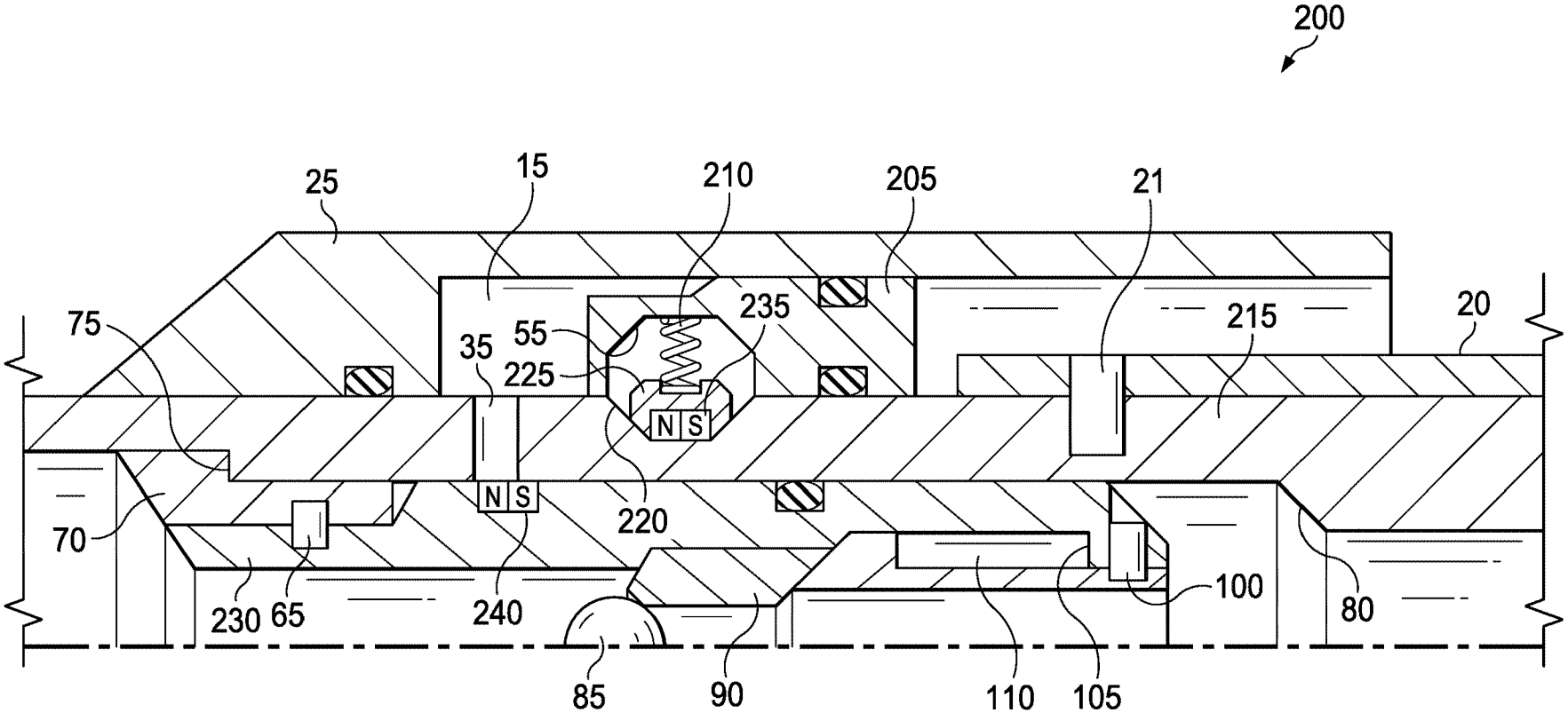
FIG. 2A is a cross-sectional view of an alternative downhole setting assembly in the run position with the ball engaged in the ball seat.
Figure 2B:
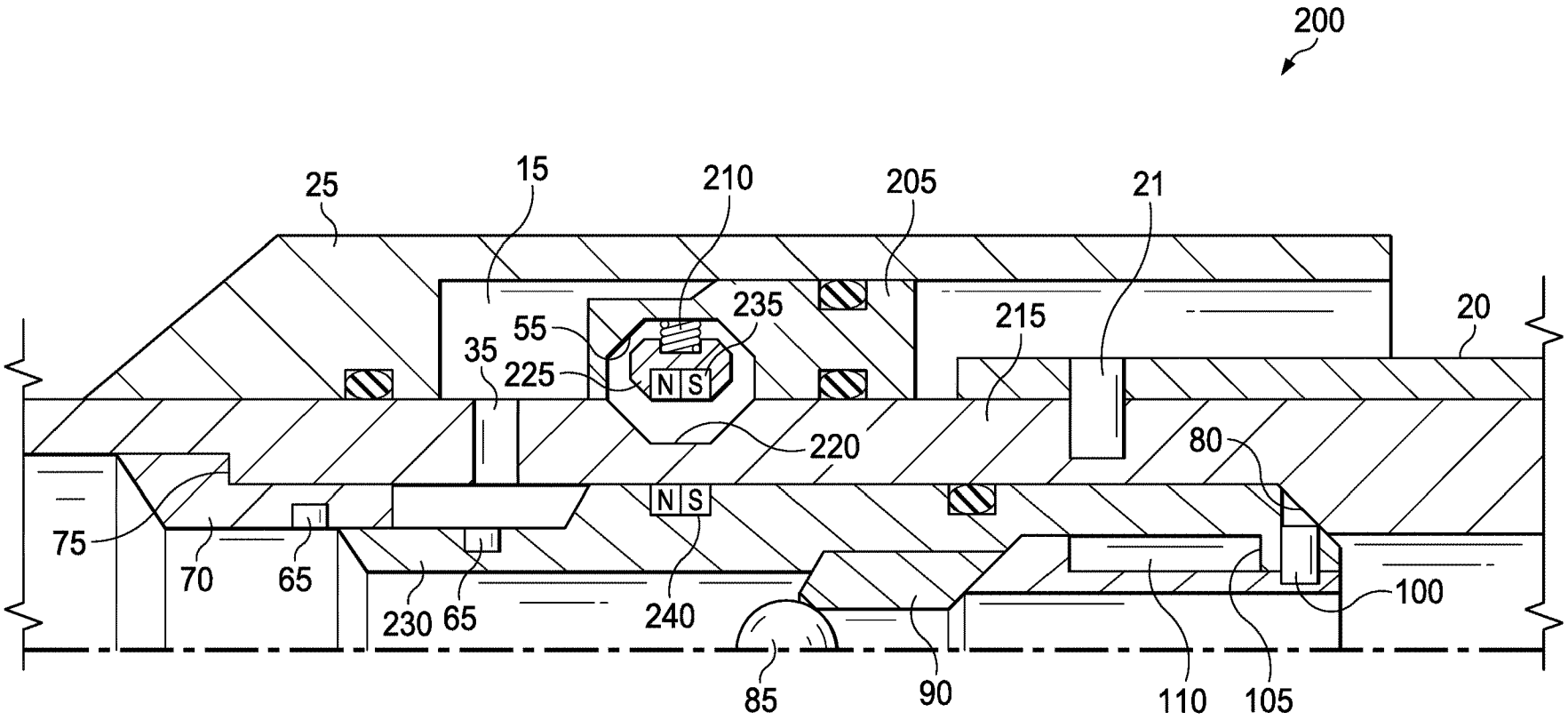
FIG. 2B is a cross-sectional view of an alternative downhole setting assembly with the lock-out sleeve sheared.
Figure 2C:
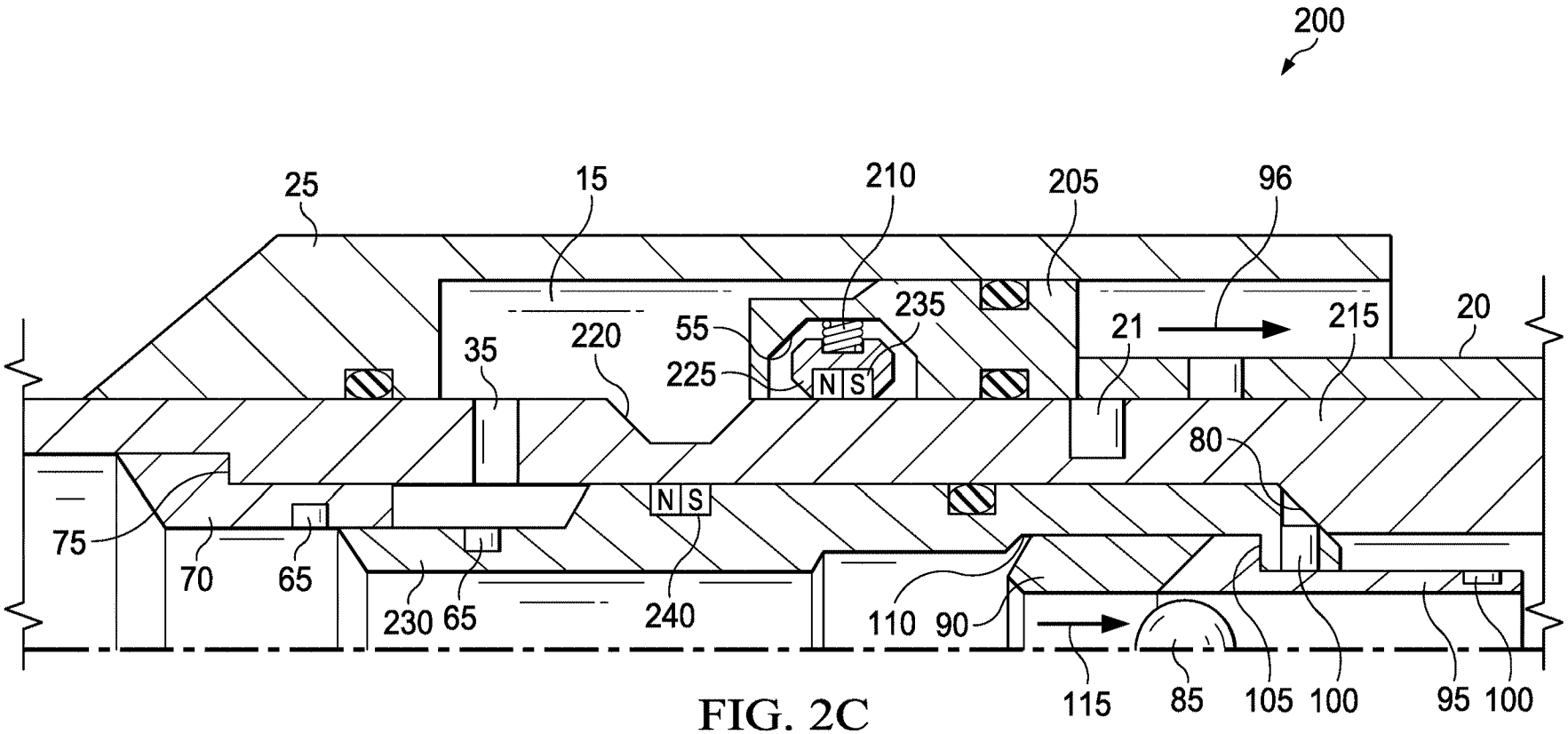
FIG. 2C is a cross-sectional view of an alternative downhole setting assembly with the setting piston fully released.

FIGS. 2A-2C illustrate a cross-sectional view of an alternative example of a downhole setting assembly 200 which is illustrated as being used in packer setting methods and systems. Downhole setting assembly 200 may be used in any packer setting tool that utilizes a pressure differential to actuate the setting mechanism. For example, downhole setting assembly 200 may be used in a hydraulic packer setting tool. Downhole setting assembly 200 comprises setting piston 205 and setting chamber 15. Setting piston 205 differs from setting piston 10 (as illustrated in FIGS. 1A-1C) in that setting piston 205 further comprises a spring 210 disposed in the profile 55 of setting piston 205. Setting piston 205 may be any type of piston suitable for moving piston extension 20. Setting chamber 15 is defined by at least the piston housing 25, the mandrel 215, an opening of port 35, and the setting piston 205. Setting piston 205 is configured such that it is capable of movement within setting chamber 15.

Port 35 is an opening through mandrel 215. Port 35 allows the pressure within setting chamber 15 to be equalized with the pressure in the wellbore. Port 35 remains open throughout the use of the downhole setting assembly 200, which includes when the packer setting tool is introduced and run in the wellbore. As such, downhole setting assembly 200 does not comprise an isolation sleeve or other such mechanism for closing or blocking port 35 in any manner such that setting chamber 15 is not in fluid communication with the wellbore. The pressure in setting chamber 15 will therefore be equalized with the pressure in the wellbore during the entirety of the packer setting operation.

Piston housing 25 and mandrel 215 at least partially define setting chamber 15. Piston housing 25 may be made of any such material sufficient for setting a packer as described above. Mandrel 215 may be made of non-ferrous materials. Examples of such nonferrous materials may include nickel-alloys. Because port 35 is in constant fluid communication with the wellbore, the pressure in setting chamber 15 will be equalized with the wellbore. As such, setting chamber 15 may not comprise an atmospheric trap as discussed above. As used herein, "atmospheric trap" refers to a setting chamber 15 which has been enclosed such that the pressure within setting chamber 15 is less than that of the pressure within the wellbore. Because setting chamber 15 may not comprise an atmospheric trap, the risk of deformation of the piston housing 25 and mandrel 215 may be reduced relative to a downhole setting assembly which comprises a setting chamber which is not in fluid communication with the wellbore throughout its operation and may comprise an atmospheric trap. Thus, piston housing 25 and mandrel 215 may be made from a wider variety of materials than may be used in packer setting assemblies where the deformation of components due to atmospheric trap is a risk.

Piston housing 25 and mandrel 215 may be any such shape and size to at least partially define a setting chamber 15 sufficient for allowing a pressure differential to act across setting piston 205. Additionally, piston housing 25 and mandrel 215 are of sufficient size to accommodate setting piston 205.

In the example illustrated in FIGS. 2A-2C, mandrel 215 comprises a groove 220 which is adjacent to and faced outwardly towards the setting chamber 15. As illustrated, the groove 220 is not cut through the entirety of the width of the mandrel 215. In some alternative examples, the groove 220 may be substituted for a slot (e.g., slot 40 as illustrated in FIGS. 1A-1C) which is cut through the entirety of the width of mandrel 215. The groove 220 may be any such size and shape to accommodate mating element 225. Mating element 225 is disposed in groove 220 and is coupled to spring 210. Mating element 225 is biased outwardly away from setting piston 205 by spring 210. Spring 210 is illustrated as a compression spring; however, spring 210 may be any spring or mechanism capable of biasing mating element 225 outwards from setting piston 205.

As illustrated in FIG. 2A, as mating element 225 is biased outwardly from setting piston 205, a portion of mating element 225 extends outwardly from profile 55 of setting piston 205 into groove 220 of mandrel 215. Groove 220 is a cut-out in the profile of the outer diameter of mandrel 215. The portion of mating element 225 disposed within groove 220 physically constrains setting piston 205 from translating as illustrated in FIG. 2A. Therefore, even as the pressure within setting chamber 15 increases, setting piston 205 cannot translate until mating element 225 no longer constrains setting piston 205. Mating element 225 may be any such size and shape necessary to constrain setting piston 205. Mating element 225 may be made of any such material sufficient for constraining setting piston 205. Groove 220 may be any such size and shape necessary to accommodate the portion of mating element 225 used to constrain setting piston 205.

As discussed above, mating element 225 is disposed in groove 220 of mandrel 215 in the run position of the downhole setting assembly 200 as illustrated in FIG. 2A. Mating element 225 as illustrated in FIGS. 2A-2C is different from mating element 45 as illustrated in FIGS. 1A-1C in that mating element 225 further comprises a magnet 235. Lock-out sleeve 230 is adjacent to mandrel 215. Lock-out sleeve 230 comprises a magnet 240. Magnet 230 and magnet 240 are positioned in downhole setting assembly 200 such that their poles are aligned in the same direction. For example, the north pole of magnet 235 will point in the same direction of the north pole of magnet 240. Magnet 240 is disposed in lock-out sleeve 230 such that in the run position illustrated by FIG. 2A, magnet 240 is unable to repel magnet 235 out of groove 220. As will be explained below and as illustrated in FIGS. 2B and 2C, lock-out sleeve 230 may be induced to move such that magnet 240 of lock-out sleeve 230 is adjacent to magnet 235 of mating element 225 in such a vicinity and position to repel magnet 235 by compressing spring 210 into profile 55 of setting piston 205. Spring 210 is selected such that the force required to compress a spring 210 with a spring constant of X to clear groove 220 is a lesser force than the repulsive force generated by aligning the poles of magnet 235 and magnet 240.

Lock-out sleeve 230 further comprises a shearable element 65. Shearable element 65 couples lock-out sleeve 230 to shear ring 70. Shearable element 65 and shear ring 70 as illustrated in FIGS. 2A-2C function analogously to the shearable element 65 and shear ring 70 illustrated in FIGS. 1A-1C. Shearable element 65 may be a shear pin, shear screw, or any such shearable element in which the shear strength of the shearable element 65 is known. FIG. 2A illustrates shearable element 65 as not sheared. FIGS. 2B and 2C illustrate shearable element 65 as sheared. A portion of shearable element 65 is disposed within lock-out sleeve 230, and another portion of shearable element 65 is disposed within shear ring 70. Shear ring 70 is locked into position via shoulder 75 of mandrel 215, and shear ring 70 does not move from this position. Because shear ring 70 does not move, when the shear load on shearable element 65 exceeds the shear strength of shearable element 65, shearable element 65 may be sheared as illustrated in FIGS. 2B and 2C, and lock-out sleeve 230 may be moved from the position illustrated in FIG. 2A to the position illustrated in FIGS. 2B and 2C where lock-out sleeve 230 is physically constrained by shoulder 80 of mandrel 215. As discussed above, when lock-out sleeve 230 is moved to the position in FIGS. 2B and 2C, magnet 240 is positioned such that it is adjacent to magnet 235 of mating element 225. As illustrated in FIGS. 2B and 2C, when lock-out sleeve 230 is positioned with magnet 240 of lock-out sleeve 230 adjacent to magnet 235 of mating element 225, the poles of magnet 240 and magnet 235 may be aligned such that magnet 235 is repelled. As magnet 235 is repelled, it compresses spring 210. As explained above, the spring 210 is selected such that the force required to compress a spring 210 with a spring constant of X to clear groove 220 is a lesser force than the repulsive force generated by aligning the poles of magnet 235 and magnet 240. Further, the profile of the groove 220 and the profile of the mating element 225 may be designed such that the pressure differential acting across the setting piston 205 allows the setting piston 205 to push the mating element 225 up further into the profile 55 of the setting piston 205 when the spring 210 is compressed enough to allow the setting piston 205 to begin to translate.

In examples, the mechanism of moving lock-out sleeve 230 comprises introducing ball 85 into the wellbore such that ball 85 engages ball seat 90. This mechanism is analogous to the mechanism of moving lock-out sleeve 50 described above and illustrated in FIGS. 1A-1C. Ball 85 may be any such ball used to engage ball seat 90. Isolation of the area uphole of the ball seat 90 is accomplished by introducing the ball 85 such that it engages with the ball seat 90 of the downhole setting assembly 5. When the ball 85 engages with the ball seat 90, a fluid and pressure tight seal is created by this engagement that prevents fluid communication downhole of the ball seat 90. When the pressure and fluid tight seal is created, pressure may build in the area uphole of the ball seat 90. This pressure may be increased by the use of pumps on the surface or other such means for increasing the pressure in the area uphole of the ball seat 90. As the pressure uphole of the ball seat 90 increases, the pressure differential acting across the lock-out sleeve 230 is increased, and this pressure differential increases the shear load on shearable element 65 until the shear strength of shearable element 65 is exceeded. Shearable element 65 is then sheared, and the lock-out sleeve 230 is moved to the position illustrated in FIGS. 2B and 2C where it is braced against shoulder 80 of mandrel 215. At this position, the poles of magnet 235 are adjacent to and aligned with the poles of magnet 240 such that magnet 240 and consequently mating element 225 are repelled, and this repulsive force compresses spring 210 such that mating element 225 is moved into profile 55, and setting piston 205 is no longer constrained by mating element 225. Setting piston 205 is now free to translate, and the pressure differential acting across setting piston 205 may translate setting piston 205 such that setting piston 205 moves piston extension 20 and sets a packer as illustrated by arrow 96 in FIG. 2C which completes the packer setting portion of the operation.

Ball 85 may be passed through downhole setting assembly 200 in an analogous mechanism as described with regards to downhole setting assembly 5 above and as illustrated in FIGS. 1A-1C. As ball 85 is maintained in engagement with ball seat 90 after lock-out sleeve 230 is moved to the position illustrated in FIGS. 2B and 2C, the fluid and pressure tight seal from said engagement is maintained. As such, pressure may continue to build uphole of ball seat 90. As pressure builds uphole of ball seat 90, a pressure differential acts across the ball 85 and ball seat 90. Shear ring 95 is coupled to ball seat 90 such that the pressure differential acting across ball seat 90 also acts across shear ring 95 as illustrated in FIGS. 2B and 2C. Shear ring 95 further comprises a shearable element 100. Shearable element 100 couples lock-out sleeve 230 to shear ring 95. Shearable element 100 may be a shear pin, shear screw, or any such shearable element in which the shear strength of the shearable element 100 is known. FIGS. 2A and 2B illustrate shearable element 100 as not sheared. FIG. 2C illustrates shearable element 100 as sheared. A portion of shearable element 100 is disposed within lock-out sleeve 230, and another portion of shearable element 100 is disposed within shear ring 95. As the pressure differential acting across ball seat 90 increases, so too does the pressure differential acting across shear ring 95. As a consequence, this increase in the pressure differential also increases the shear load on shearable element 100. When the shear load on shearable element 100 exceeds the shear strength of shearable element 100, shearable element 100 may shear as illustrated in FIG. 2C. The shearing of shearable element 100 allows the ball seat 90 and shear ring 95 to move into the position illustrated in FIG. 2C where they are braced against shoulder 105 of lock-out sleeve 230. Ball seat 90 may be biased radially outwards such that when shearable element 100 is sheared, ball seat 90 moves into the groove 110 of the lock-out sleeve 230. When ball seat 90 is in the position illustrated by FIG. 2C, the diameter of the adjacent pathway for the ball 85 is increased and is greater than the diameter of the ball 85. Ball 85 is now able to pass through the downhole setting assembly 200 as indicated by arrow 115 illustrated in FIG. 2C. As the ball 85 is no longer engaged with ball seat 90, the fluid and pressure tight seal from the engagement is removed, and fluid communication between the zone uphole and the zone downhole of the ball seat 90 is reestablished. Operations requiring fluid circulation, for example, sand control, may then be performed.

FIGS. 1A-2C illustrate piston extension 20 comprising shear element 21 coupled to mandrel 30 or mandrel 215. A shearable element 21 placed in the piston extension 20 is a common way to increase the pressure needed to set the packer and thus prevent premature setting in packer setting tools due to an unforeseen increase in wellbore pressure. As the examples illustrated in FIGS. 1A-2C show, the setting piston 10 or setting piston 205 is physically constrained and thus cannot move if the wellbore pressure increases. As such, downhole setting assembly 5 and downhole setting assembly 200 may be used with a piston extension 20 that does not comprise a shearable element 21 or any such mechanism for restraining the actuation of piston extension 20. Shearable element 21 is optional and may or may not be present dependent upon the type and model of packer setting tool the downhole setting assembly 5 or downhole setting assembly 200 is used with.

Figure 3A:
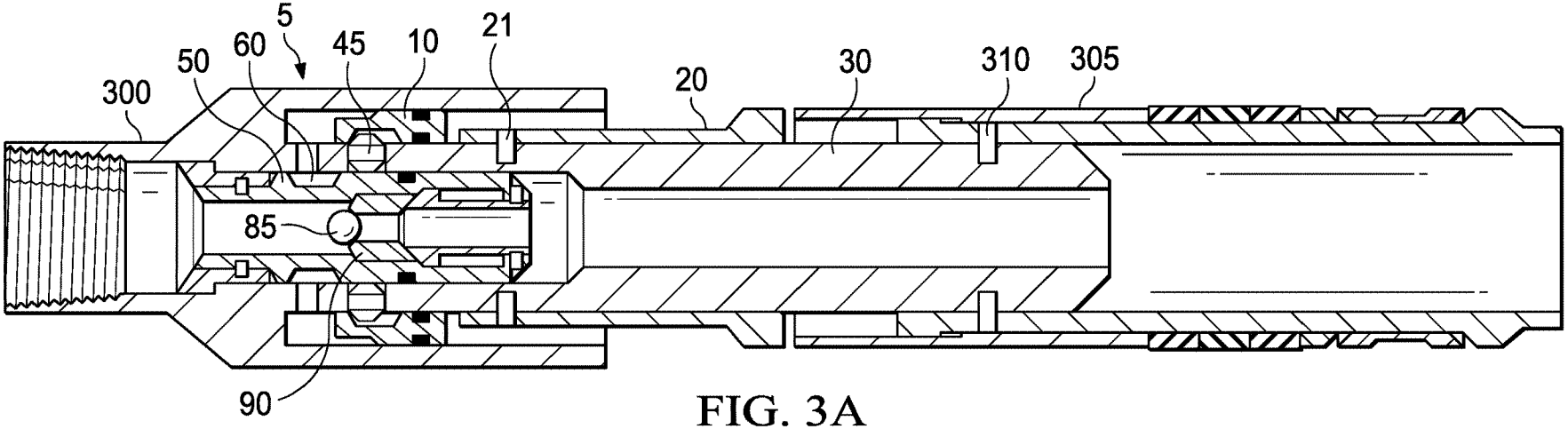
FIG. 3A is a cross-sectional view of a packer setting tool in the run position with the ball engaged in the ball seat of the downhole setting assembly.
Figure 3B:
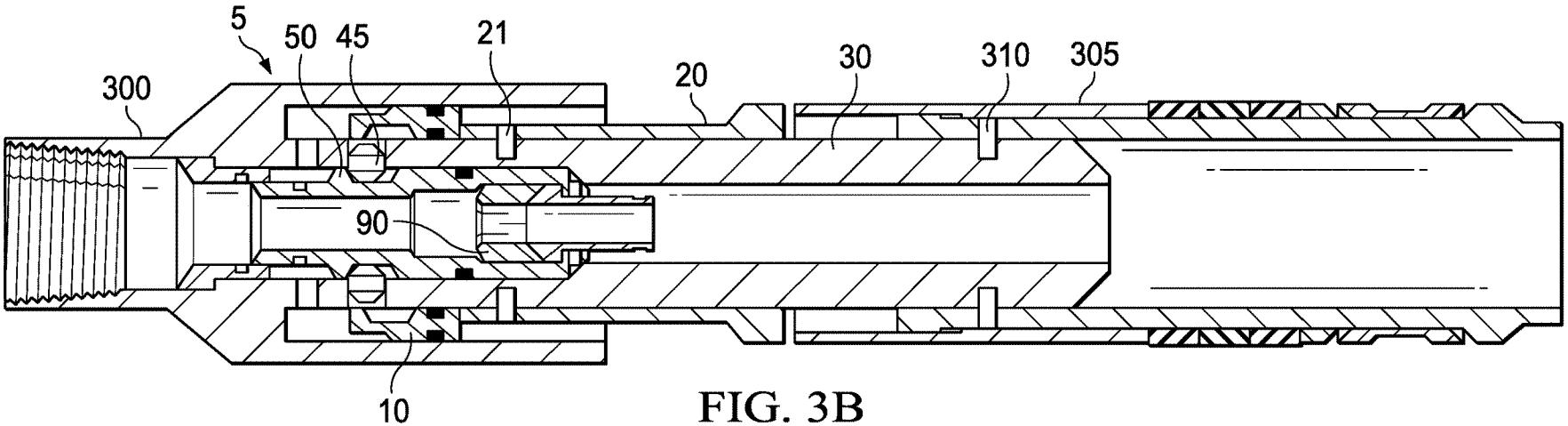
FIG. 3B is a cross-sectional view of a packer setting tool when the lock-out sleeve of the downhole setting assembly has been sheared.
Figure 3C:
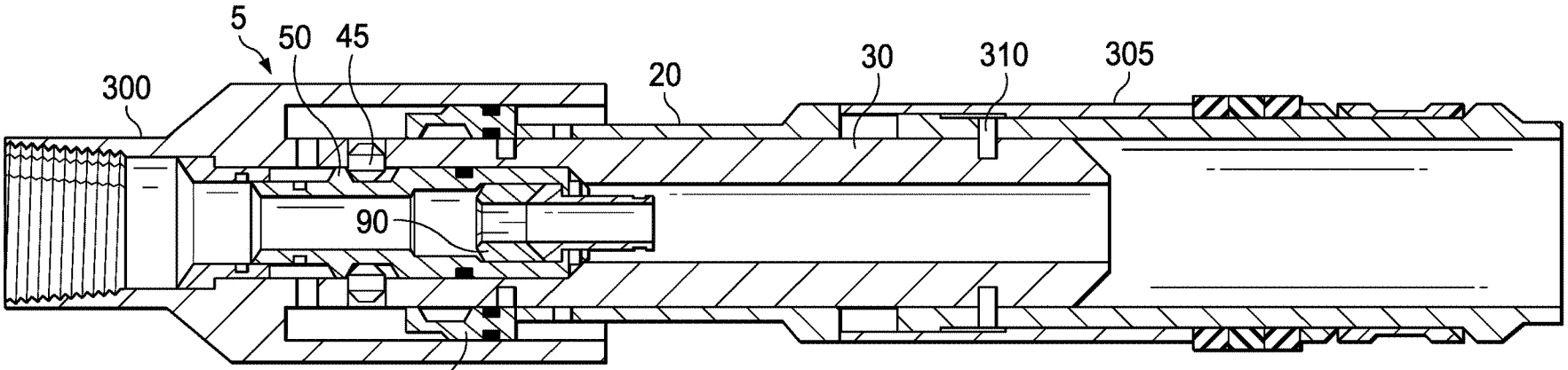
FIG. 3C is a cross-sectional view of a packer setting tool when the setting piston has released and the piston extension has contacted the packer.
Figure 3D:
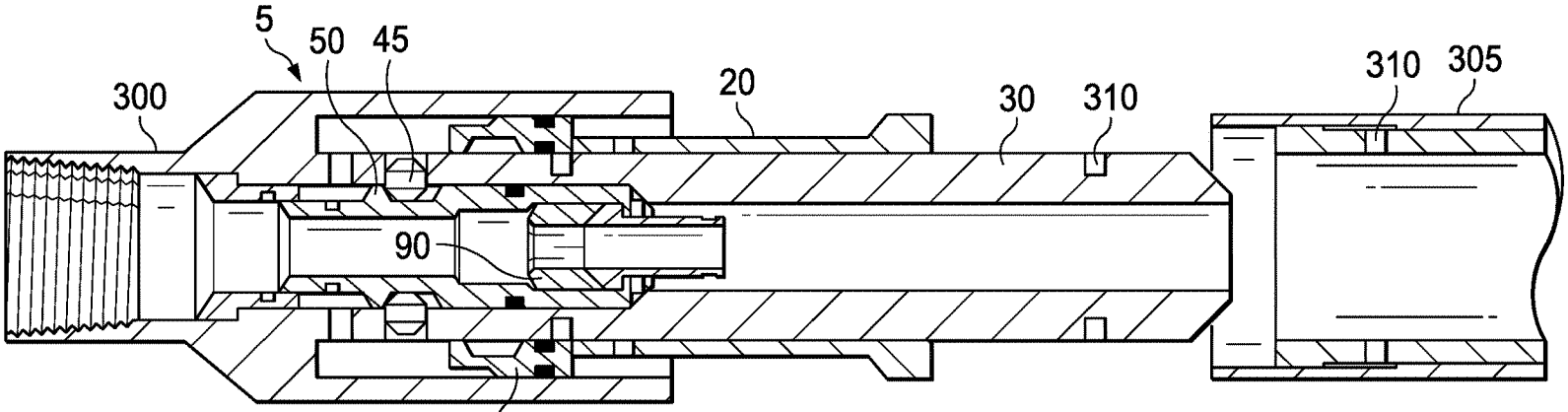
FIG. 3D is a cross-sectional view of a packer setting tool when the packer has been set.

FIGS. 3A-3D illustrate a cross-sectional view of a packer setting tool 300 and a packer 305 for use in packer setting methods and systems. Packer setting tool 300 comprises downhole setting assembly 5 as illustrated in FIGS. 1A-1C. When ball 85 is dropped, pressure builds uphole of ball seat 90 as illustrated in FIG. 3A. This increase in pressure induces lock-out sleeve 50 to move to the position illustrated in FIGS. 3B-3D. Mating element 45 may then be pushed towards groove 60 in lock-out sleeve 50 as setting piston 10 begins to translate. As pressure continues to build uphole of ball seat 90, ball seat 90 is induced to move into the position illustrated in FIGS. 3B-3D and ball 85 passes through downhole setting assembly 5. As illustrated in FIG. 3C, setting piston 10 contacts and exerts a force against piston extension 20 which is sufficient to shear shearable element 21. Shearable element 21 is optional, and some alternative examples may not comprise shearable element 21. Piston extension 20 may then contact packer 305. As illustrated in FIG. 3D, shearable element 310 which couples packer 305 to mandrel 30 is then sheared, and packer 305 is set.

Although FIGS. 1A-3D describe the downhole setting assembly as not integrated with the downhole tool to be set (e.g., the packer as illustrated above), it is to be understood that the disclosure expressly contemplates examples where the downhole tool has an integrated downhole setting assembly, and thus, a separate downhole setting tool (e.g., packer setting tool 300 as illustrated in FIGS. 3A-3D) is not required. For example, a packer (e.g., packer 305 in FIGS. 3A-3D) may itself comprise the downhole setting assembly (e.g., downhole setting assembly 5 as illustrated in FIGS. 1A-1C).

Downhole setting systems for use in subterranean formations are provided. An example downhole setting system comprises a downhole setting assembly and a downhole tool configured to be set by the downhole setting assembly. The downhole setting assembly comprises a setting piston, and a mating element that physically constrains the setting piston from translating; the mating element configured to release and permit the setting piston to translate. The downhole setting system may further comprise a lock-out sleeve with a profile configured to mate with at least a portion of the mating element. The downhole setting system may further comprise a setting chamber, wherein the pressure in the setting chamber is equalized with the hydrostatic pressure in the wellbore at the location of the downhole setting assembly. The downhole setting system may further comprise a mandrel, wherein the mandrel comprises a slot configured to permit the mating element to move therethrough. The mandrel may further comprise a setting port which is not obstructed. The downhole setting system may not comprise an isolation sleeve configured to obstruct a setting port. The downhole setting system may further comprise a piston extension adjacent to the setting piston, wherein the piston extension does not comprise a shearable element. The downhole setting system may further comprise a ball and a ball seat configured to engage the ball, engagement of the ball and the ball seat creating a fluid and pressure tight seal.

Downhole setting assemblies for use in subterranean formations are provided. An example downhole setting assembly comprises a setting piston, and a mating element that physically constrains the setting piston from translating prior to actuating a downhole tool. The downhole setting assembly may further comprise a lock-out sleeve with a groove configured to hold at least a portion of the mating element. The downhole setting assembly may further comprise a setting chamber, wherein the pressure in the setting chamber is equalized with the hydrostatic pressure in the wellbore at the location of the packer setting tool. The downhole setting assembly may further comprise a mandrel, wherein the mandrel comprises a slot through which the mating element may move. The mandrel may further comprise a setting port which is not obstructed. The downhole setting assembly may not comprise an isolation sleeve capable of obstructing a setting port. The downhole setting assembly may further comprise a piston extension adjacent to the setting piston, wherein the piston extension does not comprise a shearable element. The downhole setting assembly of may further comprise a ball and a ball seat configured to engage the ball, engagement of the ball and the ball seat creating a fluid and pressure tight seal.

Methods of setting a packer in a subterranean formation are provided. An example method of setting a packer comprises introducing a packer setting tool comprising a downhole setting assembly in a wellbore, wherein the downhole setting assembly comprises: a setting piston, and a mating element that physically constrains the setting piston from translating; the downhole setting assembly is coupled to a packer; and translating the setting piston to set the packer. The method may further comprise stopping the mating element from physically constraining the setting piston by positioning a groove in a lock-out sleeve adjacent to the mating element. Positioning a groove in the lock-out sleeve adjacent to the mating element may comprise shearing a shearable element coupled to the lock-out sleeve. Shearing a shearable element may comprise engaging a ball in a ball seat to create a pressure and fluid tight seal. The method may further comprise increasing the pressure uphole of the ball seat. The pressure may be increased at least until the shear load on the shearable element exceeds the shear strength of the shearable element. The downhole setting assembly may further comprise a setting chamber, wherein the pressure in the setting chamber is equalized with the hydrostatic pressure in the wellbore at the location of the packer setting tool. The downhole setting assembly may further comprise a mandrel, wherein the mandrel comprises a slot through which the mating element may move. The mandrel may further comprise a setting port which is not obstructed. The downhole setting assembly may not comprise an isolation sleeve capable of obstructing a setting port. The downhole setting assembly may further comprise a piston extension adjacent to the setting piston, wherein the piston extension does not comprise a shearable element. The downhole setting assembly of may further comprise a ball and a ball seat configured to engage the ball, engagement of the ball and the ball seat creating a fluid and pressure tight seal.

Therefore, the disclosed systems and methods are well adapted to attain the ends and advantages mentioned, as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown other than as described in the claims below. It is therefore evident that the particular illustrative embodiments disclosed above may be altered, combined, or modified, and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. A downhole setting system comprising:

a downhole setting assembly comprising:

a setting piston, a mating element that physically constrains the setting piston from translating; the mating element configured to release and permit the setting piston to translate; wherein the mating element comprises a lug, a ball, a key, or any combination thereof;

a mandrel, wherein the mandrel comprises a slot configured to permit the mating element to move radially inward through the mandrel; and a downhole tool configured to be set by the downhole setting assembly; wherein the translation of the setting piston initiates the setting of the downhole tool.

2. The downhole setting system of claim 1 further comprising a lock-out sleeve with a profile configured to mate with at least a portion of the mating element.

3. The downhole setting system of claim 1; wherein the downhole setting assembly is disposed in a wellbore and wherein the downhole setting assembly further comprises a setting chamber, wherein the pressure in the setting chamber is equalized with the hydrostatic pressure in the wellbore at the location of the downhole setting assembly; wherein increasing the pressure in the setting chamber induces translation of the setting piston.

4. The downhole setting system of claim 1, wherein the mandrel further comprises a setting port which is not obstructed; wherein the setting port is a passage allowing pressure to be conveyed to the setting piston.

5. The downhole setting system of claim 1, wherein the downhole setting system does not comprise an isolation sleeve configured to obstruct a setting port; wherein the setting port is a passage allowing pressure to be conveyed to the setting piston.

6. A downhole setting assembly comprising:

a setting piston, wherein translation of the setting piston actuates a downhole tool, a mating element that physically constrains the setting piston from translating prior to actuating the downhole tool; wherein the mating element comprises a lug, a ball, a key, or any combination thereof; and a mandrel, wherein the mandrel comprises a slot configured to permit the mating element to move radially inward through the mandrel.

7. The downhole setting assembly of claim 6, further comprising a lock-out sleeve with a groove configured to hold at least a portion of the mating element.

8. The downhole setting assembly of claim 6, wherein the downhole setting assembly is disposed in a wellbore and wherein the downhole setting assembly further comprises a setting chamber, wherein the pressure in the setting chamber is equalized with the hydrostatic pressure in the wellbore at the location of the downhole setting assembly; wherein increasing the pressure in the setting chamber induces translation of the setting piston.

9. The downhole setting assembly of claim 6, wherein the mandrel further comprises a setting port which is not obstructed; wherein the setting port is a passage allowing pressure to be conveyed to the setting piston.

10. The downhole setting assembly of claim 6, wherein the downhole setting assembly does not comprise an isolation sleeve capable of obstructing a setting port; wherein the setting port is a passage allowing pressure to be conveyed to the setting piston.

11. The downhole setting assembly of claim 6, further comprising a piston extension adjacent to the setting piston, wherein the piston extension does not comprise a shearable element.

12. The downhole setting assembly of claim 6, further comprising a ball and a ball seat configured to engage the ball, engagement of the ball and the ball seat creating a fluid and pressure tight seal; wherein the engagement of the ball with the ball seat creates a pressure differential which translates the setting piston.

13. A method of setting a packer comprising:

introducing a packer setting tool comprising a downhole setting assembly in a wellbore, wherein the downhole setting assembly comprises:

a setting piston, and a mating element that physically constrains the setting piston from translating; wherein the mating element comprises a lug, a ball, a key, or any combination thereof; the downhole setting assembly is coupled to a packer;

a mandrel, wherein the mandrel comprises a slot configured to permit the mating element to move radially inward through the mandrel; and translating the setting piston to set the packer.

14. The method of claim 13 further comprising stopping the mating element from physically constraining the setting piston by positioning a groove in a lock-out sleeve adjacent to the mating element.

15. The method of claim 14, wherein the positioning a groove in the lock-out sleeve adjacent to the mating element comprises shearing a shearable element coupled to the lock-out sleeve.

16. The method of claim 15, wherein the shearing a shearable element comprises engaging a ball in a ball seat to create a pressure and fluid tight seal; wherein the engagement of the ball with the ball seat creates a pressure differential which shears the shearable element.

17. The method of claim 16 further comprising increasing the pressure uphole of the ball seat.

18. The method of claim 17, wherein the pressure is increased at least until the shear load on the shearable element exceeds the shear strength of the shearable element.

19. The method of claim 13, wherein the mandrel further comprises a setting port which is not obstructed; wherein the setting port is a passage allowing pressure to be conveyed to the setting piston.

20. The method of claim 13, wherein the downhole setting assembly does not comprise an isolation sleeve capable of obstructing a setting port; wherein the setting port is a passage allowing pressure to be conveyed to the setting piston.

* * * * *